United States Patent [19]

Walter

[11] 4,427,079

[45] Jan. 24, 1984

[54] INTERMITTENTLY ROTATABLE DOWN HOLE DRILLING TOOL

[76] Inventor: Bruno H. Walter, 45 College St., Kingston, Ontario, Canada, K7L 4L5

[21] Appl. No.: 322,402

[22] Filed: Nov. 18, 1981

[51] Int. Cl.[3] ..... E21B 4/02

[52] U.S. Cl. ..... 175/106; 175/101; 175/107; 175/323; 308/217

[58] Field of Search ..... 175/93, 101, 106, 107, 175/319, 323; 166/237; 308/217; 464/20, 21, 180, 183

[56] References Cited

U.S. PATENT DOCUMENTS

| | | | |
|---|---|---|---|
| 941,732 | 11/1909 | Scott . | |
| 1,494,064 | 5/1924 | Gelman . | |
| 1,690,429 | 11/1928 | Osgood . | |
| 2,002,386 | 5/1935 | Bannister | 175/106 |
| 2,013,070 | 9/1935 | Sheridan | 175/106 |
| 2,507,585 | 5/1950 | Bassinger | 255/27 |
| 2,584,978 | 2/1952 | Bassinger | 255/4.4 |
| 2,662,505 | 12/1953 | Cline, Jr. | 121/27 |
| 2,764,130 | 9/1956 | Bassinger | 121/16 |
| 2,937,008 | 5/1960 | Whittle | 175/106 |
| 3,537,555 | 11/1970 | Reister et al. | 308/217 |
| 3,847,229 | 11/1974 | Wanner et al. | 173/48 |
| 3,871,193 | 3/1975 | Young | 464/21 |
| 4,044,844 | 8/1977 | Harris et al. | 173/73 |
| 4,209,070 | 6/1980 | Sudnishnikov et al. | 173/78 |
| 4,299,296 | 11/1981 | Geczy | 175/101 |

*Primary Examiner*—Stephen J. Novosad
*Assistant Examiner*—William P. Neuder
*Attorney, Agent, or Firm*—Bacon & Thomas

[57] ABSTRACT

In a down hole drilling tool a closed valve is operatively moved downwards by pressurized drilling mud pumped down the drill string, the valve when it attains its lower position being opened and being returned under the influence of a spring or other upwardly urging means acting on the valve to its upper position at which the valve is closed thereby to complete the cycle of operations. The valve is so continuously coupled to a torque member that the downward movement of the valve causes turning of the torque member in one direction, and the upward movement of the valve causes turning of the torque member in the opposite direction. A drill bit mounted on the lower end of a rotor is connected through a one-way clutch to the torque member so that during the downward movement of the valve the rotor and drill bit are rotatably driven by the torque member but are stationary during the upward movement of the valve, the drill bit thus being operatively intermittently rotated. During the upward movement of the valve the pressurized drilling mud flows through the open valve and issues from the drill bit as high pressure and volume flushing jets while the drill bit is stationary, thereby providing more effective cleaning of cuttings and chips from the bottom of the bore hole being formed by the drill bit. Aligned annular grooves are provided in the rotor and in the housing in which the rotor is mounted, ball bearings being disposed partially in each of these grooves thereby to provide an axial thrust bearing capable of transmitting high axial thrust from the housing to the rotor and hence to the drill bit. Lipped pockets are also provided in the rotor in communication with the grooves therein, with the ball bearings being disposed within these pockets during assembly and disassembly of the rotor and housing.

25 Claims, 27 Drawing Figures

INTERMITTENTLY ROTATABLE DOWN HOLE DRILLING TOOL

BACKGROUND OF THE INVENTION

This invention in accordance with one aspect thereof is concerned with drilling tools of the type which may be used for drilling oil and gas wells to a great depth in the earth's crust.

It is common practice to provide such a drilling tool in which the drill bit which is disposed at the lower end of the tool is operatively rotated, during which fluid commonly referred to as drilling mud is pumped through the drill string and the associated heavy drill collars to flushing ducting in the drill bit from which the drilling mud exits in the form of a pressurised jet or jets, this jet or jets of drilling mud serving to clean the bottom of the bore hole being cut by the drill bit with the cuttings and chips formed by the drill bit being carried upwardly by the drilling mud along an annular space between the drill string and the wall of the bore hole formed by the drill bit to the surface at which the drilling mud may be cleaned and reused.

As will be appreciated, the torque required to rotate the long drill string is very considerable in view of the weight of the drill collars disposed above the drill bit and, more particularly, in view of the frictional resistance which requires to be overcome, the drill string in view of its very considerable length seldom being truly straight so that this frictional resistance is thereby increased. With the view to eliminating or at least minimizing these disadvantages it has hitherto been known to provide a down hole motor for operatively driving the drill bit and which is disposed at the lower end portion of the drill string and above the drill bit, or to provide a hammer or percussive motor by which a hammer or percussive effect is operatively applied to the drill bit.

A number of designs of such down hole motor and percussive or hammer motor devices have been developed, one of the most widely used designs which utilizes a positive displacement motor being that marketed under the trademark Dynadrill, but certain disadvantages inherent to this design such as, for example, the relatively low torque available from the motor and its relatively short operating life together with the fact that a principal component of the motor is constructed from an elastomer which precludes use of the motor in thermal bore holes have restricted the use of this design of device to cases where higher costs and shorter operational life are acceptable.

In alternative designs of down hole motors the motors are constituted by axial flow turbines, but these forms of motors which are known as turbodrills require that at the surface the fluid for operation of the turbines be at an extremely high pressure and high volume fluid flows are required. Furthermore, such motors are also very expensive to manufacture and maintain, and since low torque but high rotational speed are characteristics of these turbodrills the use of such down hole motors which have mainly been restricted to cases where the drill bits are diamond tipped is not ideal where the motors operatively drive core rock bits.

In all the above-described prior forms of down hole motors the drill bits are operatively continuously rotated so that in these down hole motors, and also in percussive or hammer devices where the drill bits are operatively continuously rotated from the surface by the drill string, there are still substantial associated frictional forces and there is an inevitable reduction in the pressure of the drilling mud leaving from the drill bits because of the work required to be performed by the drilling mud in rotating the drill bits, or in actuating the percussive or hammer motors. The cleaning action of the jet or jets on the bottom of the bore hole being formed by the drill bit is thus correspondingly reduced. Furthermore, the continuous operative rotation of the drill bit impedes the drilling mud jet or jets from the drill bit so that turbulence is created with resultant loss in the pressure and energy of the drilling mud jet or jets and hence with a resultant reduction in the cleaning action on the bottom of the bore hole, this turbulence being further increased if the drill bit incorporates toothed cones which also rotate during operative rotation of the drill bit. Thus, cuttings and chips tend to remain on the bottom of the bore hole and act as a cushion against which the drill bit operates thereby significantly reducing the rate of drilling.

In the hitherto known forms of percussive or hammer devices the member which provides the percussive or hammer effect is spaced from the drill bit, or from a member on which the drill bit is directly or indirectly mounted, except at the moment of impact during each cycle of operation of the device, and in use such percussive or hammer devices can result in breakage of the drill bit or other damage to the device.

A further aspect of the present invention is concerned with axial thrust bearings which may be used in down hole drilling tools in accordance with said one aspect of the present invention but which may also be used in other forms of apparatus particularly where high axial thrust forces are involved, and a still further aspect of the present invention is concerned with the provision of a method of assembly of such an axial thrust bearing.

SUMMARY OF THE INVENTION

It is a primary object of said one aspect of the present invention to provide a down hole drilling tool which is of improved form in that the above-described disadvantages of the hitherto known forms of down hole motors and percussive or hammer devices are substantially obviated or mitigated, since the above-mentioned turbulence in the drilling mud jet or jets with the drill bit tending to operate on a cushion of cuttings or chips at the bottom of the bore hole is substantially avoided, and the forces operatively applied to the drill bit are substantially automatically controlled thereby to reduce risk of breakage of the drill bit or other damage to the tool.

A down hole drilling tool in accordance with this one aspect of the present invention comprises an elongated hollow housing having a longitudinal axis and having an upper end and a lower end, and a fluid control valve which is mounted within the housing for axial movement between an upper position and a lower position. The fluid control valve comprises a first valve member and a second valve member movable relative to the first valve member between a closed condition of the valve in which the valve substantially prevents downward flow of pressurized fluid through the housing and an open condition of the valve in which downward flow of pressurised fluid is permitted through the valve, the valve being upwardly urged. The valve presents valve actuation means which on operative downward movement of the valve under the influence of pressurized fluid thereabove and against the influence of the upward urging of the valve and during which the valve is in its closed condition causes actuation of the valve to its open condition when the valve attains its lower position. On operative upward movement of the valve under the influence of the upward urging of the valve and during which the valve is in its open condition the valve actuation means causes actuation of the valve to its closed condition when the valve attains its upper position. A torque member is rotatably mounted within the housing and is continuously coupled to the first valve member. Helically disposed first coupling means and second coupling means engaged with the first coupling means are provided for operative rotation of the torque member in one direction during downward movement of the first valve member and operative rotation of the torque member in the opposite direction during upward movement of the first valve member. A drill bit is rotatably mounted on and projects downwardly from the lower end of the housing, and a one-way clutch interconnects the torque member and the drill bit for drivingly coupling the torque member to the drill bit only during operative rotation of the torque member in said one direction whereby the drill bit is operatively intermittently rotated. Fluid flushing ducting is provided in the drill bit, and fluid flow passage means interconnects the valve with the fluid flushing ducting for operative flow of pressurised fluid through the valve, the fluid flow passage means and the fluid flushing ducting in the drill bit only while the torque member is operatively rotating in said opposite direction during which the valve is in its open condition and the drill bit is non-rotating.

It is a primary object of said further aspect of the present invention to provide an axial thrust bearing which is of simple form and may be easily and inexpensively manufactured and which can accommodate extremely high axial thrust forces.

An axial thrust bearing according to this further aspect of the present invention comprises a cylindrical tubular member having an inner face, and a cylindrical member disposed within said tubular member and having an outer face adjacent the inner face of said tubular member. At least one annular groove is provided in the inner face of said tubular member, with an annular groove being provided in the outer face of said cylindrical member in alignment with said groove in said tubular member. Said aligned grooves together constitute a ball bearing track, and a plurality of freely movable ball bearings is disposed in the ball bearing track partially in each of said grooves whereby axial thrust on one of said members may be transmitted through the ball bearings to the other of said members. An annular lipped pocket is provided in one of said faces of said members in communication with the annular groove therein for retaining the ball bearings therein during assembly and disassembly of said members.

In accordance with said still further aspect of the present invention there is provided a method of assembly of an axial thrust bearing according to said further aspect of the invention and in which there is a plurality of the ball bearing tracks each constituted by th alighed grooves with a corresponding plurality of the annular lipped pockets each associated with a respective one of the ball bearing tracks. The method comprises the steps of assembling the thrust bearing with at least one of said members being unhardened by disposing the plurality of ball bearings in each annular pocket with the lip thereon upwardly directed to retain the ball bearings therein, relatively axially moving said members to bring each annular pocket into alignment with the respective groove in the other of said members, and inverting said members and further relatively axially moving said members to align the grooves in said members, with the plurality of ball bearings being transferred from each annular pocket to be disposed partially in each groove of the respective aligned grooves. Said members are then relatively rotated under load to seat the plurality of ball bearings in the groove of said at least one unhardened member, and thereafter the thrust bearing is disassembled, said at least one unhardened member is hardened, and said assembling of the thrust bearing is repeated.

BRIEF DESCRIPTION OF THE DRAWINGS

In order that the invention may be more clearly understood and more readily carried into effect the same will now, by way of example, be more fully described with reference to the accompanying drawings in which.

DESCRIPTION OF THE PREFERRED EMBODIMENTS

Figure 1:
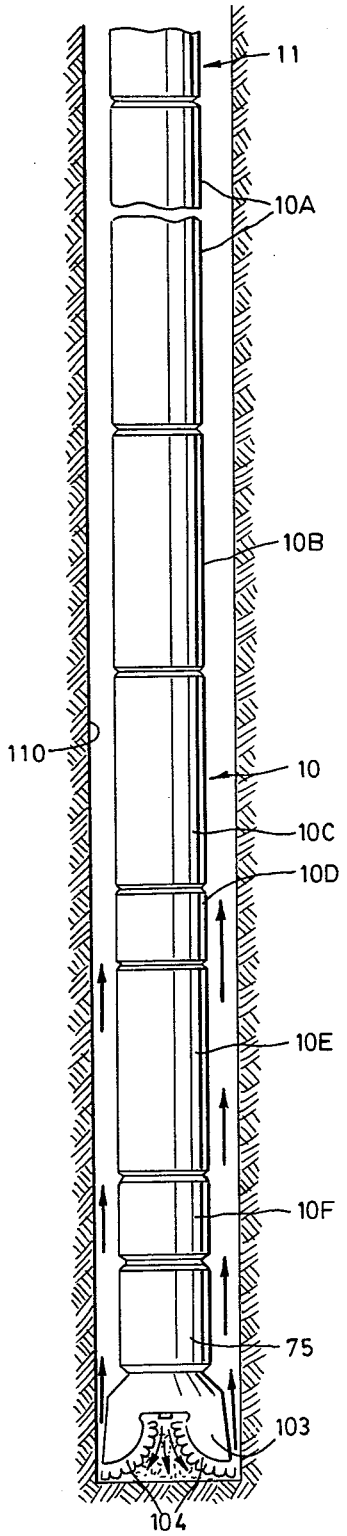
FIG. 1 is a view of well drilling tool according to a preferred embodiment of said one aspect of the present invention, and incorporating an axial thrust bearing according to a preferred embodiment of said further aspect of the invention.

Referring to the drawings and in particular to FIGS. 1 to 11, inclusive, 10 denotes generally an elongated hollow housing which comprises a plurality of pipe sections or subs 10A through 10F, inclusive, disposed at the lower end of a drill string 11 (FIG. 1), the subs 10A to 10E, inclusive, being interconnected by tapered screw-threading 12 as is conventional in the art. The section 10F is connected to the section 10E by axial screw threading 13. The housing 10 has a substantially vertical longitudinal axis 14, with the end 15 of the housing 10, i.e. the left-hand end of the sub 10A as viewed in FIG. 2 operatively constituting the upper end of the housing 10 and the end 16 of the housing 10, i.e. the right-hand end of the pipe section 10F as viewed in FIG. 6 operatively constituting the lower end of the housing 10.

Mounted within the housing 10 is a fluid control valve denoted generally by the reference numeral 17 and comprising in the preferred embodiment shown in FIGS. 1 to 21, inclusive, a spool valve incorporating a first valve member 18 which includes an inner cylindrical member 19, and a second valve member 20 which includes an outer cylindrical member 21 coaxially slidably mounted on the inner cylindrical member 19, rows of angularly spaced fluid flow openings 22 being provided in the inner cylindrical member 19, and corresponding rows of angularly spaced fluid flow openings 23 being provided in the outer cylindrical member 21, so that on relative axial movement between the first and second valve members 18, 20 as hereinafter more fully described the rows of apertures 22, 23 may be brought into overlapping relationship (FIG. 11) in which the valve 17 is in an open condition thereof, and into non-overlapping relationship (FIG. 3) in which the valve 17 is in a closed condition thereof. As will be appreciated there could, of course, be only one row of openings with only one corresponding row of openings 23, or merely one opening 22 with one corresponding opening 23. Spaced piston rings 24 are mounted on the inner cylindrical member 19 in sealing contact with the outer cylindrical member 21, and further spaced piston rings 25, together with spaced wear rings 26 are mounted on the inner cylindrical member 19 in sealing contact with the sub 10B.

At its upper end portion the outer cylindrical member 21 has an inwardly directed annular shoulder 27 and a short cylindrical portion 28 which is secured by means of angularly spaced pins 29 to a cylindrical sleeve 30. This sleeve 30 is axially slidably mounted on a shaft 31, the upper end portion of which is screw threadedly connected to the lower end of a further shaft 32. Screw threadedly mounted on the upper end of the sleeve 30 is a collar 33 on which is mounted a wiper ring 34 and an O-ring seal 35 bearing on the shaft 31.

Figure 2:
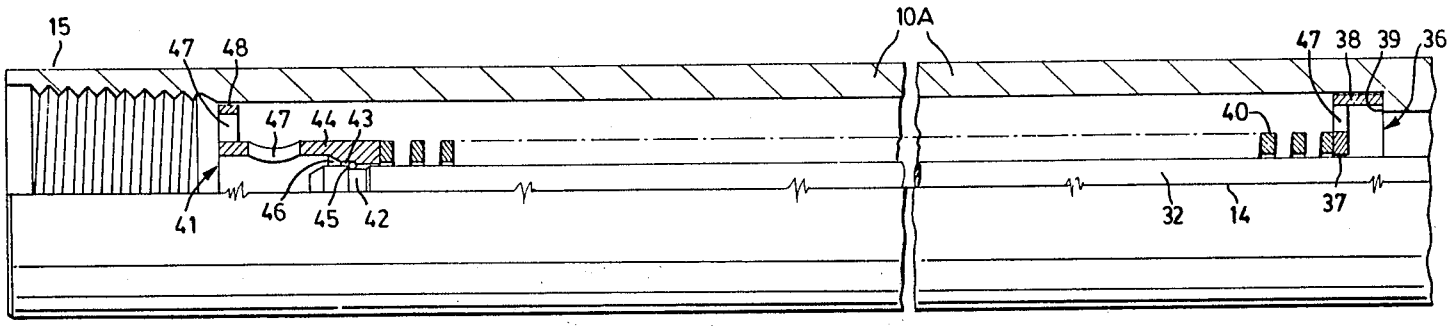
FIGS. 2, 3, 4, 5 and 6 together show on an enlarged scale the well drilling tool of FIG. 1, and the axial thrust bearing incorporated therein, in longitudinal axial section on one side of a longitudinal axis thereof, with the left-hand end of FIG. 3 being a continuation from the right-hand end of FIG. 2, the left-hand end of FIG. 4 being a continuation from the right-hand end of FIG. 3, the left-hand end of FIG. 5 being a continuation from the right-hand end of FIG. 4, and the left-hand end of FIG. 6 being a continuation from the right-hand end of FIG. 5.
Figure 3:
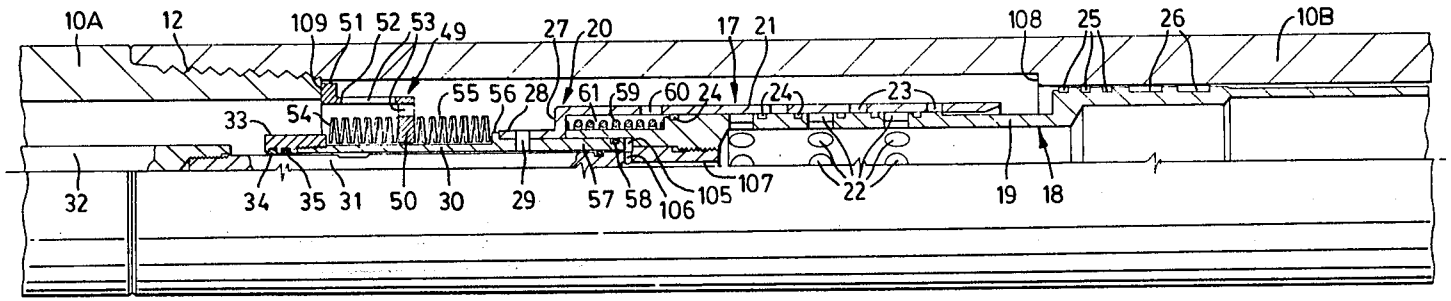
Figure 4:
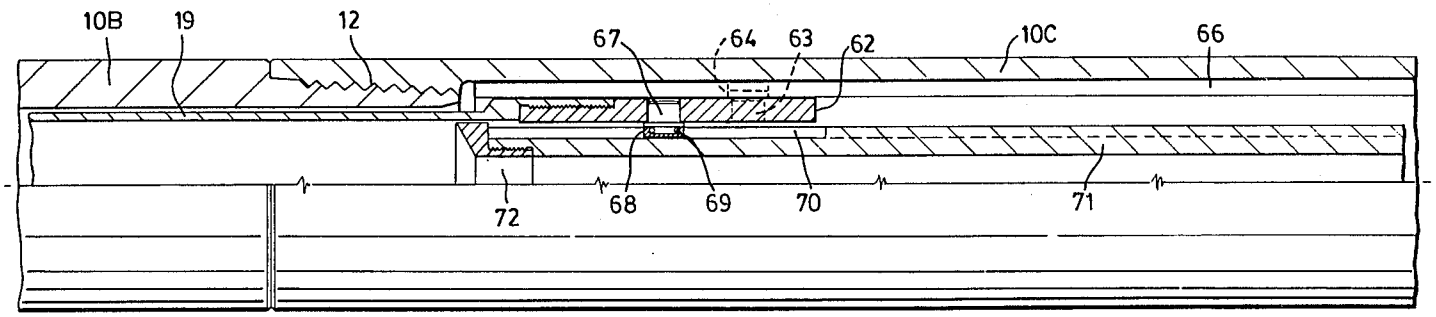

A bracket 36 comprising a flange 37 and a short cylindrical portion 38 which is in abutting contact with a shoulder 39 presented by the sub 10A is slidably mounted on the shaft 32 with a compression coil spring 40 surrounding the shaft 32 and acting between the bracket 36 and a spring support member 41 mounted on the upper end portion of the shaft 32. This mounting of the member 41 on the shaft 32 comprises an annular groove 42 provided in the upper end portion of the shaft 32 and an aligned annular groove 43 provided in a skirt portion 44 of the member 41, a plurality of ball bearings 45 each being disposed partially within the groove 42 and partially within the groove 43. The spring support member 41 is also provided with an annular pocket 46 which is disposed above and in communication with the groove 43, this pocket 46 having a radial width sufficient to accommodate the plurality of ball bearings 45 when, during assembly of the member 41 on the shaft 32, the shaft 32 is initially disposed through the member 41. The bottom of the annular pocket 46 is inwardly and downwardly inclined so that when the member 41 is urged downwardly against the influence of the spring 40 the ball bearings 45 descend downwardly and inwardly across this inclined bottom of the pocket 46 to be partially disposed in the groove 42. The member 41 is then released whereupon under the influence of the spring 40 the member 41 moves axially upwardly relative to the shaft 32 partially to dispose the ball bearings 45 in the groove 42 and partially in the groove 43. With the ball bearings 45 so disposed (as shown in FIG. 2) the ball bearings 45 serve to prevent further upward movement of the member 41 relative to the shaft 32 and thereby secure the spring 40 about the shaft 32. In order to disassemble the spring 40 from the shaft 32 the above-described operations are performed in reverse and in the reverse sequence, and as will be appreciated this assembly provides a simple and convenient arrangement for assembly and disassembly of the spring 40 on the shaft 32. A fluid flow opening or openings 47 are provided in the skirt portion 44 and a guide flange portion 48 of the member 41 and in the flange 37 of the bracket for a purpose which is hereinafter explained.

Presented by the second valve member 20 is an abutment means 49 which is in the preferred embodiment of FIGS. 1 to 21, inclusive, comprises an inner flange portion 50, an outer flange portion 51 and an intermediate cylindrical portion 52, a fluid flow opening or preferably angularly spaced fluid flow openings 53 being provided in the inner flange portion 50 and in the cylindrical portion 52. The abutment means 49 is preferably slidably mounted on the sleeve 30 between two springs 54, 55 which may be of the Belleville type, the spring 54 being disposed between one face of the flange portion 50 and the adjacent end of the collar 33, and the spring 55 being disposed between the opposed face of the flange portion 50 and an annular rib 56 presented by the sleeve 30.

The inner cylindrical member 19 is screw threadedly connected to the shaft 31 and presents a sleeve portion 57 slidably mounted on the sleeve 30, an O-ring 58 being mounted on the sleeve 30 in sealing contact with the sleeve portion 57. A relatively light spring 59 is disposed around the sleeve portion 57 and acts between the shoulder 27 and the inner cylindrical member 19, with an opening or openings 60 being provided in the outer cylindrical member 21 in communication with the chamber 61 in which the spring 59 is disposed.

Figure 5:
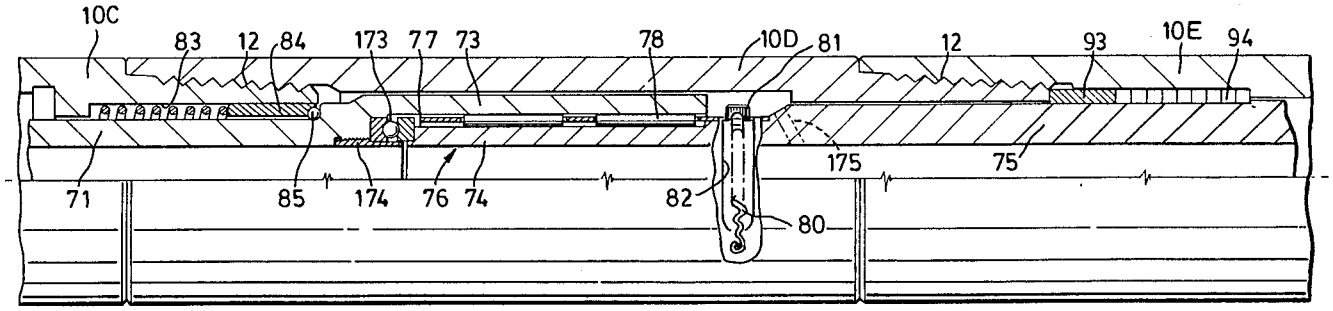
Figure 6:
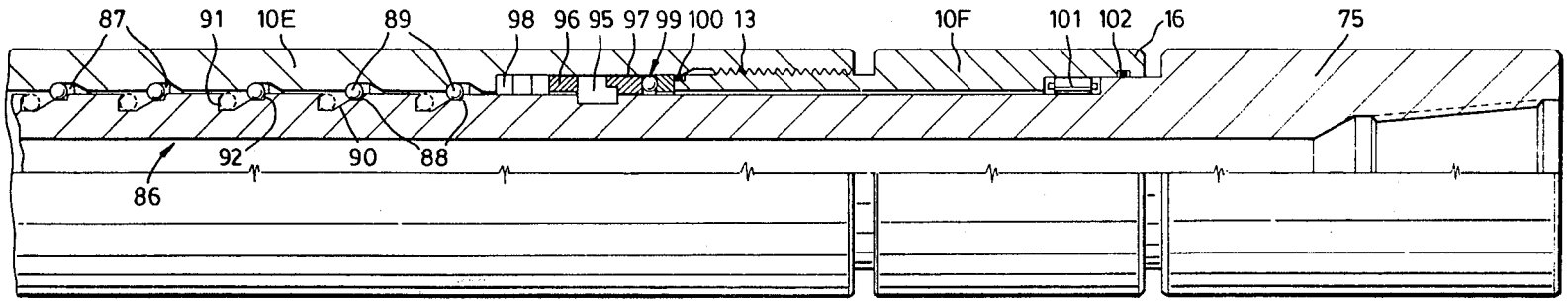
Figure 9:
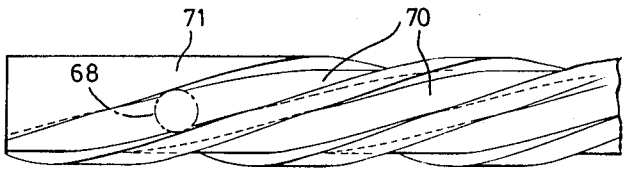
FIG. 9 is a view of a portion of the tool shown in the preceding views.
Figure 8:
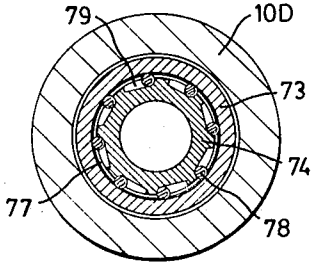
FIG. 8 is a sectioned view on the line 8—8 in FIG. 5.
Figure 7:
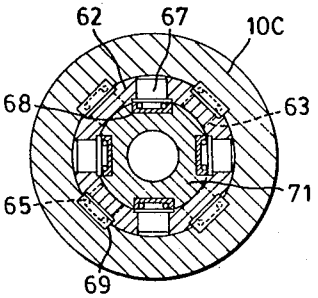
FIG. 7 is a sectioned view on the line 7—7 in FIG. 4.

Screw threadedly mounted on the lower end portion of the inner cylindrical member 19 is a cylindrical extension member 62, a stud or preferably a plurality of angularly spaced studs 63 being mounted in the member 62 with each stud 63 having an outwardly projecting end portion on which a roller 64 is rotatably mounted by means of a ball bearing race 65. The rollers 64 are each engaged within an axially disposed groove 66 provided in the inner face of the sub 10C, for preventing rotation of the first valve member 18, the rollers 64 each being freely rotatable about an axis substantially at right angles to the longitudinal axis of the respective groove 66. A further stud or preferably a further plurality of angularly spaced studs 67 are mounted in the member 62 with end portions of these studs 67 projecting inwardly therefrom and each having a roller 68 rotatably mounted thereon by means of a ball bearing race 69, these rollers 68 each being disposed within a helical groove 70 provided in a hollow tubular torque member 71, the upper end of which has screw-threadedly mounted thereon an end collar 72. The helical grooves 70 thus constitute helically disposed first coupling means with the rollers 68 constituting second coupling means continuously engaged with the first coupling means, the rollers 68 each being freely rotatable about an axis substantially at right angles to the longitudinal axis of the respective groove 70. The lower end portion 73 of the torque member 71 is coaxially disposed around the upper end portion 74 of a hollow cylindrical rotor 75, these end portions 73, 74 constituting elements of a one-way clutch 76 which may be of conventional form and which also comprises an intermediate roller cage 77 in which rollers 78 disposed in tapered slots 79 in the end portion 74 are rotatably mounted. As shown in FIG. 5, a spring 80 is connected between the cage 77 and a screw 81 which is mounted in the end portion 74 and which is positioned in a part-circumferential slot 82 in the cage 77, thereby resiliently to maintain the clutch 76 in the condition in which it is ready for driving engagement. The torque member 71 is resiliently urged downwardly by a spring 83 acting on an annular member 84, a ball beaing race 85 being disposed between the member 84 and the torque member 71. A further ball bearing race 173 is disposed between the upper end of the upper end portion 74 of the rotor 75 and the adjacent face of the torque member 71, a sleeve 174 which supports the ball bearing race 173 being screw-threadedly mounted on the torque member 71. Also fluid flow ducting 175 is provided in the rotor 75 for drainage of any fluid in the space occupied by the lower end portion 73 of the torque member 71 into the interior of the rotor 75.

Below the one-way clutch 76 there is incorporated an axial thrust bearing 86 which comprises a cylindrical tubular member constituted by the sub 10E and a cylindrical member constituted by the rotor 75, a plurality of annular grooves 87 being provided in the inner face of the sub 10E, and a corresponding plurality of annular grooves 88 being provided in the outer face of the rotor 75 with each groove 88 being in alignment with one of the grooves 87. Each groove 87 and the aligned groove 88 together constitute a ball bearing track, a plurality of freely movable ball bearings 89 being disposed in this ball bearing track partially in each of the grooves 87, 88, so that downward axial thrust on the housing 10 is operatively transmitted through the thrust bearing 86 to the rotor 75. An annular pocket 90 is also provided in the rotor 75 above and in communication with each annular groove 88, the upper edge of each pocket 90 being in the form of a downwardly directed lip 91. It will, of course, be appreciated that there could be only one groove 87 and one corresponding groove 88, in which case there would be a single ball bearing track constituted by the aligned grooves 87, 88, and a single pocket 90 in communication with the groove 88. In the assembly of the axial thrust bearing 86 the rotor 75 is lowered while inverted, relative to its orientation when the tool is operatively in use, into the sub 10E, the ball bearings 89 being disposed during this lowering of the rotor 75 into the sub 10E within the pockets 90 (as shown in broken lines in FIG. 6) and being retained in these pockets 90 by the lips 91 which during the lowering of the rotor 75 into the sub 10E are, of course, upwardly directed. By relative axial movement between the rotor 75 and the sub 10E the grooves 87 are brought into alignment with the pockets 90 whereupon the rotor 75 and the pipe section 10E are inverted into the operative orientation when the tool is in use, with the result that the ball bearings 89 drop along the inclined faces of the pockets 90 to be disposed partially within the grooves 87. Thereafter, by appropriate relative axial movement between the rotor 75 and the sub 10E the ball bearings 89 are disposed partially within the grooves 87 and partially within the aligned grooves 88.

As will be appreciated, the disassembly of the axial thrust bearing 86 is achieved by performing the above-described steps in reverse and in the reverse sequence.

The above-described assembly of the axial thrust bearing 86 is initially performed after the sub 10E has been hardened by appropriate heat treatment but before the rotor 75 has been so hardened. Thereafter, the assembled axial thrust bearing 86 is mounted in a jig (not shown) in which the rotor 75 and the sub 10E are rotated relative to one another for an appropriate period of time until the unhardened edge 92 of each groove 88 is ground to conform to the shape of the ball bearings 89 with all the ball bearings 89 in solid contact with the respective grooves 87, 88. The thrust bearing 86 is then disassembled, the rotor 75 is heated treated and hardened and the thrust bearing 86 is reassembled.

The above-described procedure is preferably adopted in order to ensure that when the axial thrust bearing 86 is operatively in use the downward axial thrust on the sub 10E is transmitted to the rotor 75 through the ball bearings 89 disposed in all the ball bearing tracks constituted by the aligned grooves 87, 88. If in the production of the rotor 75 the grooves 88 were formed in their final form, and the rotor 75 was hardened prior to the initial assembly of the thrust bearing 86 it is probable that when operatively in use the axial thrust on the sub 10E would be transmitted to the rotor 75 only through the ball bearings 89 in one of the ball bearing tracks constituted by the aligned grooves 87, 88, unless the grooves 87, 88 were manufactured to substantially no manufacturing tolerances. This would, of course, make the manufacture of the axial thrust bearing 86 extremely time-consuming and hence costly.

It will of course be appreciated that alternatively the initial assembly of the thrust bearing 86 could be performed after hardening of the rotor 75 but before hardening of the sub 10E or before hardening of the rotor 75 and sub 10E, with the unhardened member or members being hardened after the subsequent disassembly and before the re-assembly of the bearing 86.

A ring 93 and packing 94 are disposed between the rotor 75 and the sub 10E and a split ring 95 retains the rotor 75 within the housing 10, this split ring 95 being disposed between members 96, 97 with packing 98 and a ball bearing race 99 also being provided. An O-ring 100 is mounted between the subs 10E, 10F, and a roller bearing race 101 together with a seal 102 are provided between the rotor 75 and the sub 10F.

Screw-threadedly secured on the lower end of the rotor 75 is a drill bit 103 (FIG. 1) which as is conventional may incorporate a plurality of, say, three equally spaced toothed cones 104, these toothed cones 104 being operatively rotated during turning of the drill bit 103. Fluid flow ducting preferably comprising bores disposed between the toothed cones 104 is provided in the drill bit 103.

In operation, pressurized drilling mud or other fluid is continuously pumped down the drill string 11 and hollow housing 10, this pressurized drilling mud freely flowing through the conductors 47 in the member 41 and through the openings 47 in the bracket 36. The pressurized drilling mud likewise freely flows through the openings 53 in the abutment means 49 and, with the valve 17 in its closed condition shown in FIG. 3 in which the valve 17 substantially prevents flow of the pressurized drilling mud down the housing 10, acts on the valve 17 to move the valve 17 downwardly within the housing 10, the effective area on which the high pressure drilling mud operatively acts in so moving the valve 17 downwardly being an area having the diameter a (FIG. 3) since an annular chamber 105 is provided by spacing the lower end of the sleeve 30 from the inner cylindrical member 19 with radial vent passages 106 formed in the shaft 31 interconnecting this annular chamber 105 with an axial vent passage 107 formed in the shaft 31 and since the high pressure drilling mud operatively flows through the openings 60 in the outer cylindrical member 21 and between the shoulder 27 and the adjacent end of the sleeve portion 57 of the inner cylindrical member 19.

This downward movement of the valve 17 includes, of course, downward movement of the extension member 62 which is restrained against rotation by the action of the rollers 64 in the axial grooves 66. However, the axial downward movement of the extension member 62 causes turning of the torque member 71 as a result of the action of the rollers 68 within the helical grooves 70. This turning of the torque member 71 is transmitted through the one-way clutch 76 to the rotor 75 which together with the drill bit 103 mounted in the lower end thereof is thus also turned.

When the flange portion 51 of the abutment means 49 abuts a lower shoulder 108 further downward movement of the outer cylindrical member 21 of the valve 17 is thereby prevented, this arresting of the downward movement of the outer cylindrical member 21 being cushioned by the spring 54. However, continued downward movement of the first valve member 18 brings the apertures 22, 23 in the inner and outer cylindrical members 19, 21 of the valve 17 into overlapping relationship in which the valve 17 is in its open condition, thereby equalizing the drilling mud pressure on the upstream and downstream sides of the valve 17 (FIG. 11).

Figure 10:
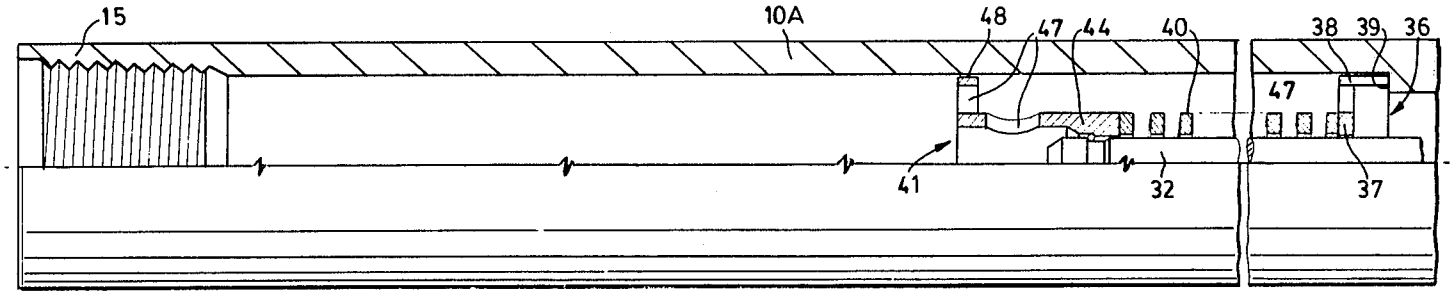
FIGS. 10 and 11 are views corresponding to FIGS. 2 and 3, respectively, but showing the tool in a different operative condition.
Figure 11:
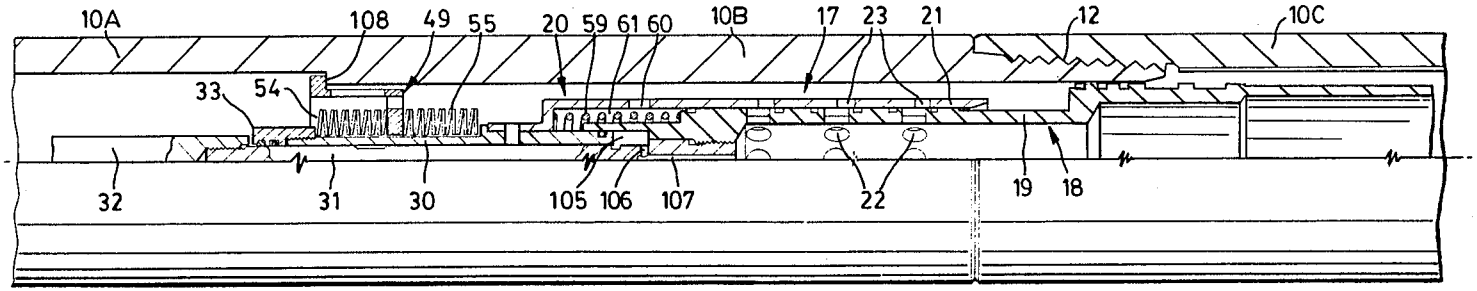

It will of course be appreciated that during the above-described downward movement of the valve 17 the downward movement of the shaft 32 results in corresponding downward movement of the spring support member 41 thereby compressing the spring 40 to the condition shown in FIG. 10 when the valve 17 is in its open condition shown in FIG. 11. Under the influence of the spring 40 the first valve member 18, together with the second valve member 20, are moved upwardly within the housing 10, the relatively light spring 59 serving to maintain the valve 17 in its open condition during this upward movement of the valve 17. When the flange portion 51 of the abutment means 49 contacts an upper shoulder 109 constituted by the lower end of the sub 10A the second valve member 20 is thereby restrained against further upward movement, this arresting of the upward movement of the second valve member 20 being cushioned by the spring 55. However, under the influence of the spring 40 the upward movement of the first valve member 18 continues, with compression of the light spring 59, until the valve 17 is again in its closed condition (FIG. 3), whereupon the above-described cycle of operations is repeated. The abutment means 49, together with the shoulders 108, 109, thus constitutes valve actuation means for causing actuation of the valve 17 to its open condition when the valve 17 attains its lower position and actuation of the valve 17 to its closed condition when the valve 17 attains its upper position.

It will of course be appreciated that during the above-described upward movement of the valve 17 the extension member 62 is likewise upwardly moved and is restrained against rotation by the engagement of the rollers 64 within the axial grooves 66. Furthermore, during this upward movement of the valve 17 the engagement of the rollers 68 in the helical grooves 70 in the torque member 71 causes turning of this torque member 71 in the opposite direction. However, this turning of the torque member 71 in said opposite direction is not transmitted through the one-way clutch 76 to the rotor 75 so that the drill bit 103 remains stationary during the upward movement of the valve 17, the rotation of the drill bit 103 thus being intermittent during operation of the tool. It will also be appreciated that during the upward movement of the valve 17 the pressurized drilling mud flows through the valve 17, which as described above is in its open condition, through the hollow torque member 71 and the hollow rotor 75 and is discharged as flushing jets through the bores in the drill bit 103 thereby to clean cuttings and chips from the bottom of the bore hole 110 (FIG. 1) being formed by the drill bit 103. While the drill bit 103 is being operatively turned flushing jets of drilling mud are, of course, also discharged through the bores in the drill bit 103 under the influence of the downward movement of the valve 17 which is in its closed condition but these flushing jets are of relatively low pressure and volume, whereas the substantially higher pressure and volume flushing jets of drilling mud while the valve 17 is in its open condition are provided only while the drill bit 103 is stationary so that turbulence which would create a resultant loss in the pressure and energy of these drilling mud jets with a resultant reduction in the cleaning action on the bottom of the bore hole 110 being drilled is substantially minimized.

Figure 13:
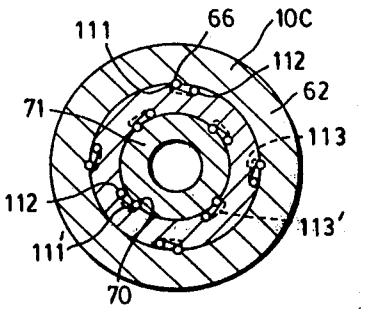
FIG. 13 is a sectioned view on the line 13—13 in FIG. 12.
Figure 14:
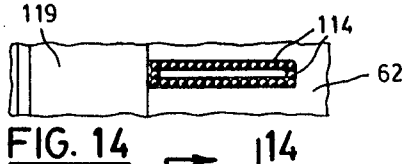
FIG. 14 is a view of part of the portion of the tool shown in FIG. 12 in the direction of the arrow 14 in FIG. 12.
Figure 12:
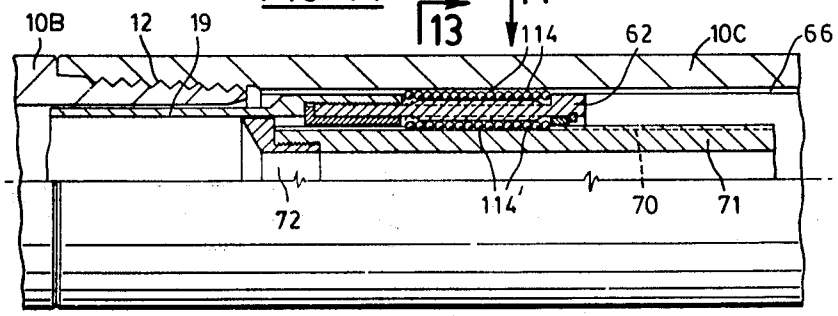
FIG. 12 is a view substantially corresponding to FIG. 4, but showing a portion of a tool according to a modified form of the preferred embodiment of the invention.

FIGS. 12, 13 and 14 show a modified form of a portion of the preferred embodiment of the tool as hereinbefore described with particular reference to FIGS. 1 to 11. FIG. 12 substantially corresponds to FIG. 4, and as will be noted in this modified form of the preferred embodiment the studs 63 and the associated rollers 64 are omitted, and instead an endless ball bearing track or preferably a plurality of angularly spaced endless ball bearing tracks are provided. As is most clearly shown in FIG. 13, each of these endless ball bearing tracks comprises one of the axially disposed grooves 66 in the sub 10C and an axially disposed first groove 111 in the extension member 62 of the first valve member 18, this first groove 111 being aligned with the groove 66 with these aligned grooves together constituting one run of the endless ball bearing track the return run of which is constituted by a further groove 112 in the extension member 62. The ends of the grooves 111, 112 in the extension member 62 are interconnected as shown at 113, and a plurality of freely movable ball bearings 114 are disposed in the ball bearing track.

Since the freely movable ball bearings 114 disposed within said one run of the endless ball bearing track are each disposed partially in the groove 111 in the extension member 62 and partially in the groove 66 in the sub 10C the first valve member 18 is thereby restrained against rotation during operative upward and downward movement of the valve 17, the ball bearings 114 operatively returning along the groove 112 which is wholly in the extension member 62 and which constitutes the return run of the endless ball bearing track.

In this modified form of the preferred embodiment a corresponding endless ball bearing track or preferably a plurality of corresponding angularly spaced endless ball bearing tracks each having a plurality of freely movable ball bearings disposed therein constitute said first and second coupling means for operatively turning the torque member 71 during upward and downward movement of the first valve member 18. These endless ball bearing tracks and associated freely movable ball bearings substantially correspond to those hereinbefore described and corresponding primed reference numerals are used to denote corresponding parts, the only difference being that in each endless ball bearing track the groove 70 in the torque member 71 is helically disposed and the aligned groove 111' which is provided in the extension member 62 is correspondingly helically disposed. The helically disposed grooves 70 in the torque member 71 constitute the first coupling means and the aligned grooves 111' in the extension member 62 constitute the second coupling means, with the ball bearings 114' constituting intermediate means continuously engaging said first and second coupling means, thereby to provide continuous engagement between said first and second coupling means.

Figure 16:
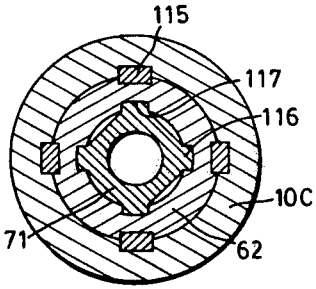
FIG. 16 is a section view on the line 16—16 in FIG. 15.
Figure 15:
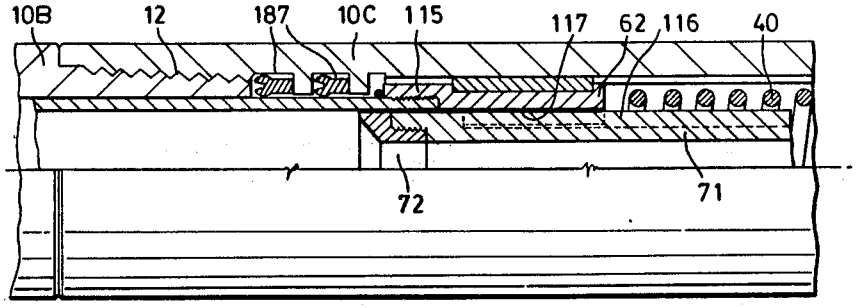
FIG. 15 is a view generally corresponding to FIG. 4 but showing a portion of a tool according to a further modified form of the preferred embodiment of the invention.

Referring now to FIGS. 15 and 16 which show a further modified form of the preferred embodiment, it will be noted that in this further modified form the studs 63 and the associated rollers 64 are replaced by an axial spline 115 mounted in the extension member 62 and which is slidably disposed within the axial groove 66 formed in the sub 10C thereby to prevent rotation of the first valve member 18 during upward and downward movement of the valve 17. Furthermore, the first coupling means comprises a helical rib or preferably a plurality of angularly spaced helical ribs 116 presented by the torque member 71, each of these ribs 116 being slidably disposed within an aligned helical groove 117 which is provided in the extension member 62 and which constitutes the second coupling means. Annular seals 187 bearing against the member 19 are provided in recesses in the sub 10C.

Furthermore, as shown in FIG. 15 the spring 40 may be relocated to surround the torque member 71 and act between the lower end of the extension member 62 and an upwardly facing shoulder (not shown) presented by the sub 10C, in order to provide said upward urging of the first valve member 18.

Figure 17:
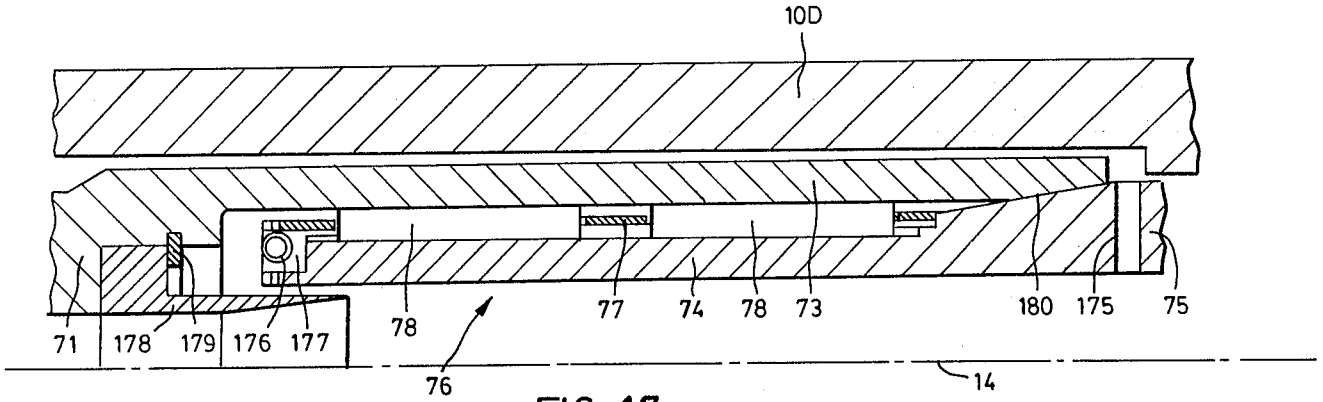
FIG. 17 is a view generally corresponding to part of FIG. 5 but on a further enlarged scale and showing the tool only to one side of the longitudinal axis, this view illustrating a further modified form of the preferred embodiment of the invention.

Referring to FIG. 17 which shows a modified form of the one-way clutch 76, it will be noted that the spring 80, the screw 81 and the slot 82 as hereinbefore described with reference to FIG. 5 are omitted, and instead a coil spring 176 is connected between the cage 77 and the upper end portion 74 of the rotor 75 in order resiliently to maintain the clutch 76 in the condition in which it is ready for driving engagement, the spring 176 being disposed within an annular recess 177 in the upper end of the upper end portion 74 of the rotor 75. An annular sleeve 178 is mounted on the torque member 71 by means of a clip 179, the sleeve 178 extending downwardly within the upper end portion 74 of the rotor 75.

Furthermore, the lower end of the lower end portion 73 of the torque member 71 and the adjacent face of the rotor 75 are of complementary conical form as indicated by the reference numeral 180, whereby during downward operative movement of the valve 17 the interengagement between the first and second coupling means results in a downward force on the torque member 71 which causes the conical lower end of the lower end portion 73 of the torque member 71 to be urged into mating frictional engagement with the conical face of the rotor 75. This assists in the driven turning of the rotor 75 by the torque member 71 through the one-way clutch 76. During upward operative movement of the valve 17 the interengagement between the first and second coupling means results in an upward force on the torque member 71 which causes the conical lower end of the lower end portion 73 of the torque member 71 to be moved out of mating frictional engagement with the conical face of the rotor 75 so that the rotor 75 is not driven by the torque member 71.

In the modified form of the one-way clutch 76 illustrated in FIGS. 18 to 21, inclusive, the adjacent annular faces of the upper end portion 74 of the hollow, cylindrical rotor 75 and the surrounding lower end portion 73 of the torque member 71 are each provided with a longitudinally extending groove or preferably a plurality of longitudinally extending, angularly spaced grooves 181, a plurality of first annular clutch plates 182 which alternate with a plurality of second annular clutch plates 183 being disposed between end rings 184 with the outer edge of the plates 182 having teeth 185 which engage within the grooves 181 in the lower end portion 73 of the torque member 71 and the inner edges of the plates 183 having teeth 186 which engage within the grooves 181 in the upper end portion 74 of the rotor 75. Thus during downward operative movement of the valve 17 the downward force on the torque member 71 causes the plates 182, 183 to be urged into mating frictional engagement with resultant driven turning of the rotor 75 by the torque member 71 through the one-way clutch 76, while during upward operative movement of the valve 17 the upward force on the torque member 71 removes the mating frictional engagement between the plates 182, 183 so that the rotor 75 is not driven by the torque member 71.

Referring now to FIGS. 22 to 26, inclusive, in which there is illustrated a portion of a down hole drilling tool according to an alternative preferred embodiment of the invention, the first valve member 18 of the valve 17 of this alternative preferred embodiment comprises a cylindrical member 118 on the lower end portion of which is screw threadedly mounted a tubular member 119. The upper end portion of the member 118 has screw threadedly connected thereto a sleeve portion 120 of a bracket 121 which also comprises parallel diametrically opposed arms 122 extending axially upwards from the sleeve portion 120 and the upper ends of which are connected by radial arms 123 to a centrally disposed, internally screw threaded boss 124. The lower end of a shaft 125 is screw-threadedly disposed through this boss 124 and is secured thereby by a lock nut 126.

The second valve member 20 of the valve 17 comprises a member 127 having a downwardly projecting central rod portion 128 on which is mounted a tubular sleeve 129 having a plurality of say, three radial arms 130 on which the member 118 of the first valve member 18 is slidably mounted thereby to guide the member 118 during operative axial movement of the first valve member 18 relative to the second valve member 20. The upper end portion of the member 127 is in the form of a short cylindrical stub 131, two diametrically opposed and axially extending limb portions 132 of a sleeve member 133 being mounted on the stub 131 and being connected thereto by means of a transversely extending pin 134. The upper end portion of the sleeve 133 presents a downward directed shoulder 135, with a relatively light spring 136 being mounted on the shaft 125 between this shoulder 135 and the upper face of the boss 124.

Figure 21:
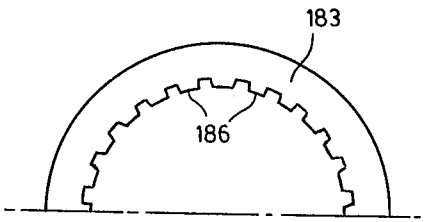
FIGS. 20 and 21 are views in the direction of the section line 19—19 in FIG. 18 of parts illustrated therein.
Figure 20:
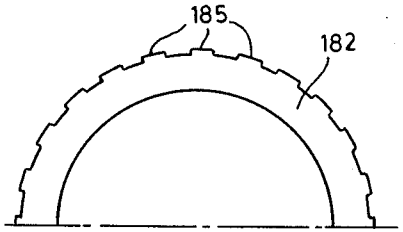
Figure 18:
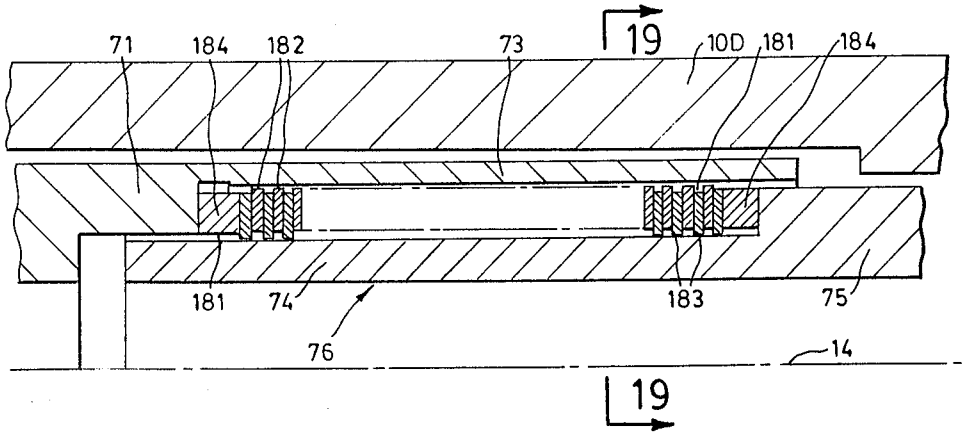
FIG. 18 is a view substantially corresponding to FIG. 17, but showing the portion in question of the tool according to a still further modified form of the preferred embodiment of the invention.
Figure 19:
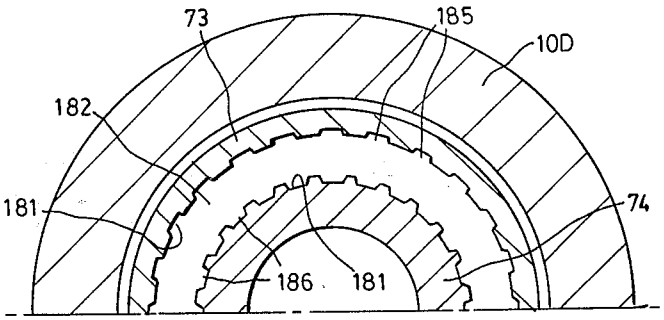
FIG. 19 is a sectioned view on the line 19—19 in FIG. 18.
Figure 24:
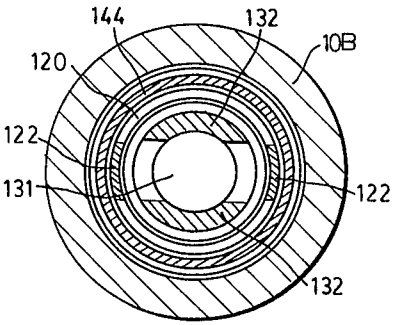
FIG. 24 is a sectioned view on the line 24—24 in FIG. 23.
Figure 25:
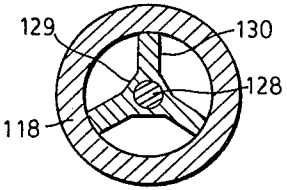
FIG. 25 is a sectioned view on the line 25—25 in FIG. 23.

As in the case of the preferred embodiment hereinbefore described with particular reference to FIGS. 1 to 11, inclusive, a coil compression spring 137 acts on the shaft 125 upwardly to urge the first valve member 18. This spring 137 acts between a collar 138 and the upper end face of a member 139 the lower end portion of which presents an annular flange 140 with the outer end portion 141, this flange 140 being radially disposed and being operatively clamped between a shoulder 142 and a sleeve 143. The collar 138 is mounted on the shaft 125 in a manner corresponding to the manner of mounting of the spring support member 41 on the shaft 32, and corresponding reference numerals are used to denote corresponding parts. Below the sleeve 143 is a linear 144 the lower end portion of which is provided with recessing comprising an axially extending slot or preferably a plurality of axially extending, annularly spaced slots 145, the purpose of which is hereinafter more fully explained. Instead of the collar 72 the upper end of the torque member 71 is provided with a shock absorber assembly which may be a multi-stage assembly comprising, as shown in FIG. 21, a spring 146 disposed within an enlarged diameter chamber 147 in the upper end portion of the hollow torque member 71, this spring 146 being between a plate 172 at the bottom of the chamber 147 and the base 148 of a cylindrical cup 149 slidably mounted within the chamber 147. A further spring 150 is disposed within the cup 149 between the base 148 and a plug 151 slidably mounted in the cup 149, a transverse pin 152 being disposed through the base 148 of the cup 149 with the ends of the pin 152 in axially elongated slots 153 in the upper end portion of the torque member 71 thereby to limit slidable movement of the cup 149 within the upper end portion of the torque member 71, and a further transverse pin 154 being disposed through the plug 151 with the ends of the pin 154 in axially elongated slots 155 in the cup 149 thereby likewise to limit slidable movement of the plug 151 within the cup 149. The springs 146, 145 may be of the Belleville type. Below the sleeve portion 120 of the bracket 121 there is mounted on the member 118 a plurality of piston rings 156 in sliding contact with the liner 144, and a bypass port or preferably a plurality of angularly spaced bypass ports 157 is provided in the member 118 below the piston rings 156. Annular wear rings 188 are mounted on the member 118 below the ports 157.

The member 139 is screw threadedly connected to the lower end portion of a sleeve 158 the upper end portion of which is screw threadedly connected to a plug member 159, with the sleeve 158 constituting a casing within which the spring 137 is disposed thereby, in this preferred embodiment, to facilitate assembly of the tool with minimized abrasion on the spring 137 during this assembly and disassembly of the tool. By replacing a screw 160 in the plug member 159 with a longer screw 155 this longer screw may be caused to operate on the upper end of the shaft 125 thereby to move the shaft 125 downwardly and thus remove the influence of the spring 137 from the shaft 125. By then separating the subs 10A, 10B and removing the lock nut 126 the shaft 125 may be disconnected from the boss 124 in order conveniently to replace the assembly comprising the shaft 125, the member 139, the sleeve 158, the plug member 159, the collar 138 and the spring 137, wrench flats 161 formed on the shaft 125 being exposed when the shaft 125 is moved downardly as described above for engagement by a suitable form of wrench (not shown) to facilitate unscrewing of the shaft 125 from the boss 124.

In operation of this alternative preferred embodiment of FIGS. 22 to 26, inclusive, pressurized drilling mud or other fluid is, as in the case of the operation of the preferred embodiment hereinbefore described with reference to FIGS. 1 to 11, inclusive, continuously pumped down the drill string 11 and elongated hollow housing 10, this pressurized drilling mud freely flowing through an opening or angularly spaced openings 162 in the flange 140 of the member 139 and, with the valve 17 in its closed condition shown in FIG. 23, acting on the valve 17 to move the valve 17 downwardly within the housing 10.

As hereinbefore described with reference to FIGS. 1 to 11, inclusive, 12, 13 and 14, or 15 and 16, this downward movement of the valve 17 causes turning of the torque member 71 in said one direction with resultant turning of the rotor 75 and the drill bit 103 through the one-way clutch 76.

When the lower end of the rod portion 128 of the second valve member 20 contacts the plug 151 this plug 151 is urged downwards against the influence of the spring 150 and the cup 149 together with the plug 151 is then urged downwards against the influence of the spring 146, thereby arresting the downward movement of the second valve member 20 in a cushioned manner. Continued downward movement of the first valve member 18 results in opening of the valve 17 (FIG. 26), as hereinbefore described with reference to FIGS. 1 to 11, inclusive.

As the downward movement of the second valve member 20 is being arrested by the multi-stage shock absorber incorporating the springs 146, 150 the uppermost of the piston rings 156 passes below the upper ends of the slots 145 in the liner 144, whereupon the high pressure drilling mud flows around the valve 17, into these slots 145 and through the bypass ports 157 to act on the downstream side of the valve 17. This equalization of the drilling mud pressure on the upstream and downstream sides of the valve 17 further assists in arresting the downward movement of the valve 17.

The valve 17 is then moved upwards in the housing 10 under the influence of the spring 137 which has, of course, been compressed during the downward movement of the valve 17 as in the preferred embodiment hereinbefore described with particular reference to FIGS. 1 to 11, inclusive. During this upward movement of the valve 17, the valve 17 is of course maintained in its open condition under the influence of the relatively light spring 136. When the upper end of the sleeve 133 of the second valve member 20 contacts a resiliently deformable ring 163 disposed between the upper end of the sleeve 133 and the member 139 the second valve member 20 is thereby restrained against further upward movement, this arresting of the upward movement of the second valve member 20 being cushioned by the resiliently deformable ring 163. However, under the influence of the spring 137 the upward movement of the first valve member 18 continues, with compression of the relatively light spring 136, until the valve 17 is again in its closed condition (FIG. 23), whereupon the above-described cycle of operations is repeated.

During the above-described upward movement of the valve 17 the torque member 71 is turned in the opposite direction with, as a result of the one-way clutch 76, the rotor 75 and the drill bit 103 being stationary as is fully described hereinbefore with reference to the preferred embodiment of FIGS. 1 to 11, inclusive, the rotation of the drill bit 103 thus again being intermittent during operation of the tool, and high pressure and volume drilling mud flushing jets again serving to provide improved cleaning of the bottom of the bore hole 110 being drilled by the drill bit 103 while the drill bit 103 is stationary.

Figure 27:
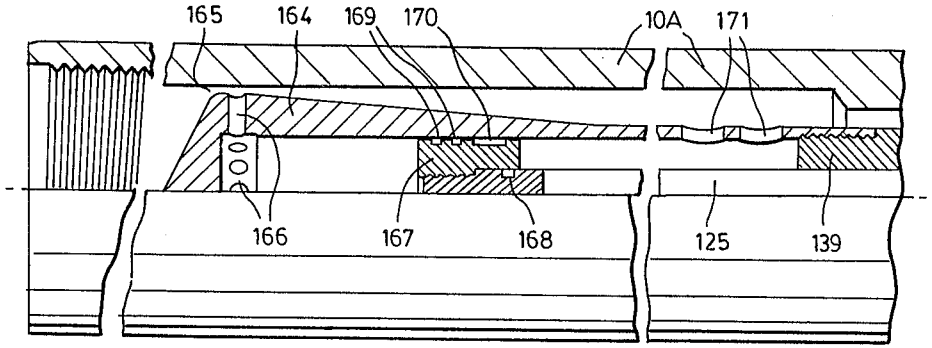
FIG. 27 is a view corresponding to FIG. 22, but showing a portion of a tool according to a modified form of said further preferred embodiment of the invention.

Referring to FIG. 27 which shows a modified form of the assembly incorporating the spring 137, this modified assembly comprises a cylinder 164 which is screw-threadedly connected to the member 139. The upper end portion of the cylinder 164 is closely spaced from the inner wall of the sub 10A to provide a restricted annular throat 165 and this throat 165 is in communication with the upper end portion of the interior of the cylinder 164 through a port or preferably a plurality of angularly spaced ports 166. Within the cylinder 164 is slidably mounted a piston 167 to which the upper end of the shaft 125 is screw threadedly connected, the shaft 125 being sealed relative to the piston 167 by an O-ring 168, and piston rings 169 together with a wear-ring 170 being mounted on the piston 167 in sliding contact with the inner wall of the cylinder 164.

An opening or angularly spaced openings 171 are provided in the cylinder 164 below the piston 167, so that in operation high pressure drilling mud passes through these openings 171 and acts on the piston 167 upwardly to urge the piston 167 and hence also the shaft 125, the high pressure drilling mud as it flows through the restricted annular throat 165 creating a venturi effect which results in reduced pressure in the upper end portion of the interior of the cylinder 164 above the piston 167.

Figure 22:
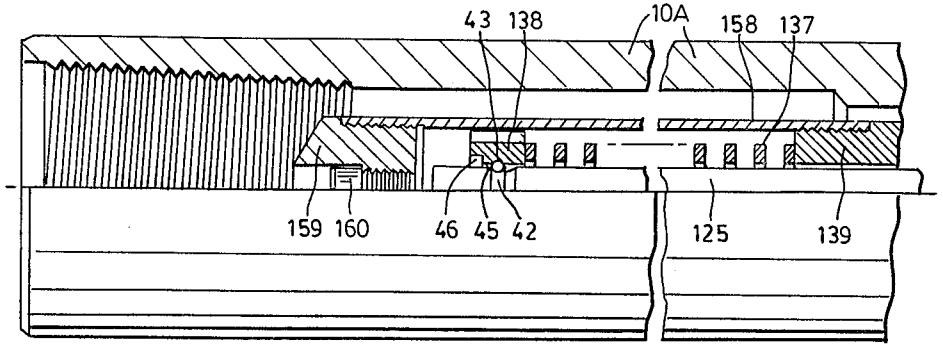
FIGS. 22 and 23 together show a portion of a well drilling tool according to a further preferred embodiment of said one aspect of the invention, these views showing the tool in longitudinal axial section on one side of a longitudinal axis thereof, with the left-hand end of FIG. 23 being a continuation from the right-hand end of FIG. 22.
Figure 23:
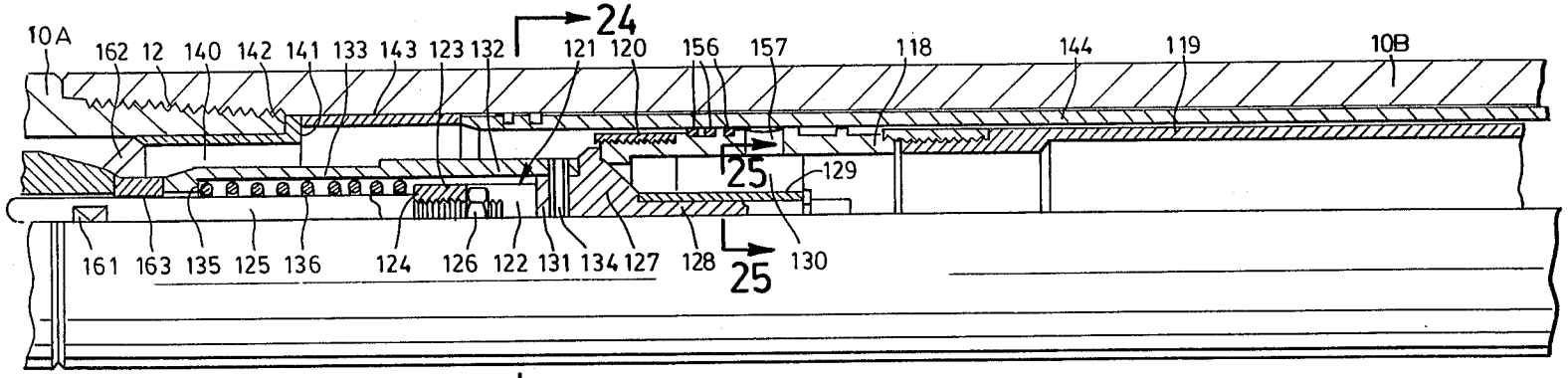
Figure 26:
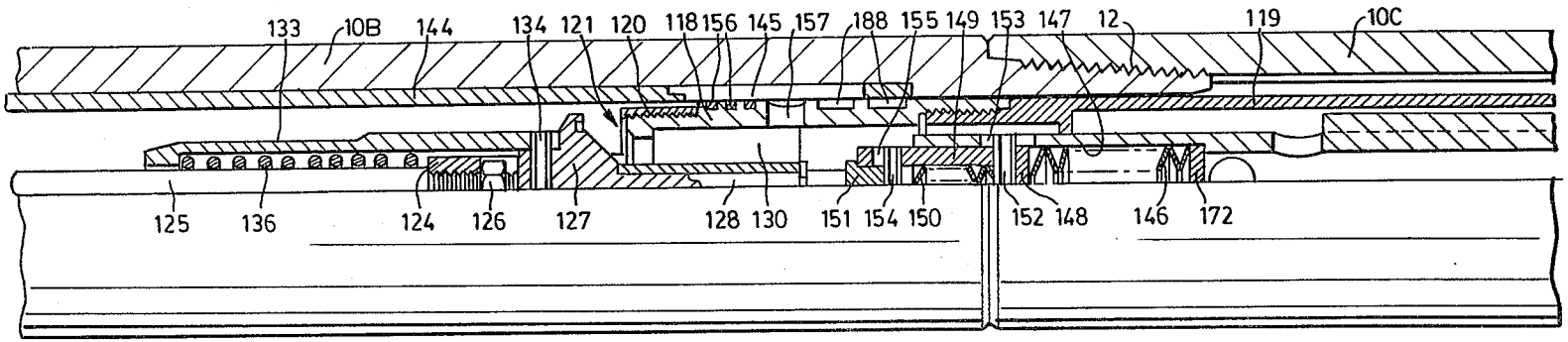
FIG. 26 is a view generally corresponding to FIG. 23, but showing the tool in a different operative condition.

Thus, this modified form of FIG. 22 serves upwardly to urge the shaft 125, and in some cases this modified form of FIG. 22 may be preferable to the assembly incorporating the spring 137 since it avoids potential problems of breakage or damage to the spring 137.

In a further alternative embodiment (not shown) the first coupling means comprising the helically disposed grooves 70 may be provided in the first valve member 18 with the second coupling means which is continuously engaged with the first coupling means being presented by the housing 10 or a member fixedly mounted thereon, and with the torque member 71 continuously connected to the first valve member 18 by axial splining. Thus, on downward and upward movement of the first valve member 18 relative to the torque member 71 the first valve member 18 and hence also the torque member 71 is turned in the appropriate direction by the interaction of the first and second coupling means.

In such a further alternative embodiment the first valve member 18 is of course operatively rotated, but if this is not desirable the first valve member 18 could be coupled to an intermediate member through a connection such that the intermediate member and the first valve member 18 operatively move upwardly and downwardly as a unit, but with the intermediate member being rotatable relative to the first valve member 18. In this case the first coupling means with which the second coupling means is continuously engaged and which comprises the helically disposed grooves 70 is provided in the intermediate member, and the axial splining connection of the torque member 71 is with the intermediate member.

It will of course be appreciated that the modified form of the means for upward urging of the valve 17 as shown in FIG. 27 may be substituted in the preferred embodiment hereinbefore described with reference to FIGS. 1 to 11, inclusive, or the modified forms thereof of FIGS. 12, 13 and 14, or 15 and 16. Also, the modified forms of the one-way clutch 76 as shown in FIG. 17 or FIGS. 18 to 21, inclusive, could of course be substituted in the alternative preferred embodiment hereinbefore described with reference to FIGS. 22 to 26, inclusive, or the modified form thereof of FIG. 27. Furthermore, in any particular case the form of the valve 17 to be used will be at least partly dependent on the diameter of the tool and the vicosity of the drilling mud operatively to be used with the tool.

I claim:

1. A down hole drilling tool comprising an elongated hollow housing having a longitudinal axis and having an upper end and a lower end, a fluid control valve which is mounted within the housing for axial movement between an upper position and a lower position and which comprises a first valve member and a second valve member movable relative to the first valve member between a closed condition of the valve in which the valve substantially prevents downward flow of pressurized fluid through the housing past the valve and an open condition of the valve in which downward flow of pressurized fluid is permitted through the valve, the valve being upwardly urged and having valve actuation means which on operative downward movement of the valve under the influence of pressurised fluid thereabove and against the influence of the upward urging of the valve and during which the valve is in its closed condition causes actuation of the valve to its open condition when the valve attains its lower position, and which on operative upward movement of the valve under the influence of the upward urging of the valve and during which the valve is in its open condition causes actuation of the valve to its closed condition when the valve attains its upper position, a torque member rotatably mounted within the housing and continuously coupled to the first valve member, helically disposed first coupling means, second coupling means engaged with the first coupling means for operative rotation of the torque member in one direction during downward movement of the first valve member and operative rotation of the torque member in the opposite direction during upward movement of the first valve member, a drill bit rotatably mounted on and projecting downwardly from the lower end of the housing, a one-way clutch interconnecting the torque member and the drill bit for drivingly coupling the torque member to the drill bit only during operative rotation of the torque member in said one direction whereby the drill bit is operatively intermittently rotated, fluid flushing ducting provided in the drill bit, and fluid flow passage means interconnecting the valve with the fluid flushing ducting for operative flow of pressurized fluid through the valve, the fluid flow passage means and the fluid flushing ducting in the drill bit only while the torque member is operatively rotating in said opposite direction during which the valve is in its open condition and the drill bit is non-rotating.

2. A down hole drilling tool comprising an elongated hollow housing having a longitudinal axis and having an upper end and a lower end, a fluid control valve which is mounted within the housing for axial movement between an upper position and a lower position and which comprises a first valve member non-rotatably mounted within the housing and a second valve member movable relative to the first valve member between a closed condition of the valve in which the valve substantially prevents downward flow of pressurized fluid through the housing past the valve and an open condition of the valve in which downward flow of pressurized fluid is permitted through the valve, the valve being upwardly urged and having valve actuation means which on operative downward movement of the valve under the influence of pressurised fluid thereabove and against the influence of the upward urging of the valve and during which the valve is in its closed condition causes actuation of the valve to its open condition when the valve attains its lower position, and which on operative upward movement of the valve under the influence of the upward urging of the valve and during which the valve is in its open condition causes actuation of the valve to its closed condition when the valve attains its upper position, a torque member rotatably mounted within the housing carrying helically disposed first coupling means, second coupling means carried by the first valve member and continuously engaging the first coupling means for operative rotation of the torque member in one direction during downward axial movement of the first valve member and operative rotation of the torque member in the opposite direction during upward axial movement of the first valve member, a drill bit rotatably mounted on and projecting downwardly from the lower end of the housing, a one-way clutch interconnecting the torque member and the drill bit for drivingly coupling the torque member to the drill bit only during operative rotation of the torque member in said one direction whereby the drill bit is operatively intermittently rotated, fluid flushing ducting provided in the drill bit, and fluid flow passage means interconnecting the valve with the fluid flushing ducting for operative flow of pressurized fluid through the valve, the fluid flow passage means and the fluid flushing ducting in the drill bit only while the torque member is operatively rotating in said opposite direction during which the valve is in its open condition and the drill bit is non-rotating.

3. A tool according to claim 2, wherein said upward urging of the valve comprises means acting on the first valve member for upward urging thereof.

4. A tool according to claim 3, wherein a portion of the first valve member extends upwardly of the second valve member, and said means acting on the first valve member for upward urging thereof comprises a compression coil spring surrounding said portion of the first valve member and acting between said portion of the first valve member and the housing to provide said upward urging of the first valve member.

5. A tool according to claim 4, further comprising a casing within which said compression coil spring is disposed.

6. A tool according to claim 4, wherein said means acting on the first valve member for upward urging thereof further comprises a spring support member and a plurality of ball bearings, the spring support member against which the spring acts being mounted on said upwardly extending portion of the first valve member, an annular groove being provided in said portion of the first valve member, an aligned annular groove being provided in the spring support member, the plurality of ball bearings each being disposed partially in each of said grooves, and an annular pocket of a width to accommodate the ball bearings being provided in the spring support member above and in communication with the groove in the spring support member, whereby by downward movement of the spring support member against the influence of the spring the pocket may be disposed in alignment with the groove in said portion of the first valve member for facilitating assembly and disassembly.

7. A tool according to claim 3, wherein said means acting on the first valve member for upward urging thereof comprises a compression coil spring surrounding the torque member and acting between a lower end of the first valve member and the housing to provide said upward urging of the first valve member.

8. A tool according to claim 3, wherein said means acting on the first valve member for upward urging thereof comprises a piston and cylinder assembly, and a restricted throat for flow therethrough of the pressurized fluid to provide a venturi effect, the cylinder above the piston which is mounted on the first valve member being in communication with the throat for reduced pressure operatively to act on an upper face of the piston and the cylinder below the piston being in communication with the interior of the housing for pressurised fluid operatively to act on a lower face of the piston, whereby operatively to provide said upward urging of the first valve member.

9. A tool according to claim 2, wherein said valve actuation means comprises abutment means presented by the second valve member, a lower, axially fixed member, and an upper, axially fixed member, the abutment means presented by the second valve member comprising a flange contactible with said lower member to prevent further downward movement of the second valve member when the valve attains its lower position, and contactible with said upper member to prevent further upward movement of the second valve member when the valve attains its upper position, and the flange being mounted on the second valve member between an upper spring and a lower spring to provide a cushioning effect to the second valve member when the valve attains its said lower and upper positions.

10. A tool according to claim 2, wherein said valve actuation means comprises recessing in the inner face of the housing, and bypass porting provided in the first valve member, whereby when the valve attains its lower position pressurized fluid may flow around the valve and through said recessing and bypass porting, substantially to equalize the pressurized fluid pressures on the valve and thereby prevent further downward movement of the valve.

11. A tool according to claim 2, wherein spring means acts between the first and second valve members to urge said members towards the open condition of the valve.

12. A tool according to claim 2, wherein the valve is a spool value with the first and second valve members comprising relatively axially slidable, coaxial cylindrical members, fluid flow apertures being provided in the cylindrical members with said apertures being in overlapping relationship when the valve is in its open condition and being out of overlapping relationship when the valve is in its closed condition.

13. A tool according to claim 2, wherein axial splining interengages the first valve member and the housing to provide said non-rotatable mounting of the first valve member within the housing.

14. A tool according to claim 2, wherein said first coupling means presented by the torque member comprises at least one helically disposed groove in the torque member, and said second coupling means presented by the first valve member comprises at least one projection engaged within said at least one groove in the torque member.

15. A tool according to claim 14, wherein said at least one projection comprises a stud mounted in the first valve member and having an end portion projecting therefrom, a roller being rotatably mounted on said end portion of the stud and being engaged within said at least one groove in the torque member for free rotation thereof about an axis substantially at right angles to a longitudinal axis of said groove in the torque member.

16. A tool according to claim 2, wherein said first coupling means presented by the torque member comprises at least one helically disposed rib presented by the torque member, and said second coupling means presented by the first valve member comprises a groove within which the rib is matingly engaged.

17. A tool according to claim 2, wherein said non-rotatable mounting of the first valve member within the housing comprises at least one axially disposed groove in the housing, and at least one stud mounted in the first valve member and having an end portion projecting therefrom, a roller being rotatably mounted on said end portion of the stud and being engaged within said at least one groove in the housing for free rotation thereof about an axis substantially at right angles to a longitudinal axis of said groove in the housing.

18. A tool according to claim 2, wherein said non-rotatable mounting on the first valve member within the housing comprises at least one axially disposed groove in the housing, an axially disposed first groove in the first valve member aligned with said groove in the housing with said aligned grooves together constituting one run of an endless ball bearing track, a further groove in the first valve member interconnecting the ends of said first groove therein and constituting a return run of the endless ball bearing track, and a plurality of freely movable ball bearings disposed in the ball bearing track.

19. A tool according to claim 2, further comprising intermediate means continuously engaging the first coupling means presented by the torque member and continuously engaging the second coupling means presented by the first valve member, thereby to provide said continuous engagement between said first and second coupling means.

20. A tool according to claim 19, wherein said first coupling means comprises at least one helically disposed groove in the torque member, said second coupling means comprises a helically disposed first groove in the first valve member aligned with said groove in the torque member with said aligned grooves together constituting one run of an endless ball bearing track, a further groove in the first valve member interconnecting the ends of the first groove therein and constituting a return run of the endless ball bearing track, and said intermediate means comprises a plurality of freely movable ball bearings disposed in the ball bearing track.

21. A tool according to claim 2, further comprising a rotor to which the drill bit is secured and which is rotatably mounted in the housing between the one-way clutch and the drill bit, the one-way clutch comprising complementary conical faces which are presented by the torque member and the rotor and which are operatively urged into mating frictional engagement by downward movement of the torque member during downward movement of the valve and out of mating frictional engagement by upward movement of the torque member during upward movement of the valve.

22. A tool according to claim 2, further comprising a rotor to which the drill bit is secured and which is rotatably mounted in the housing between the one-way clutch and the drill bit, the one-way clutch comprising a plurality of first clutch plates and a plurality of second clutch plates which alternate with the first clutch plates, the torque member having longitudinally extending grooving with teeth presented by the first clutch plates disposed within said grooving and the rotor having longitudinally extending further grooving with teeth presented by the second clutch plates disposed within said further grooving, whereby on operative downward movement of the torque member during downward movement of the valve the first and second clutch plates are urged into frictional engagement for rotational driving of the rotor by the torque member, and on operative upward movement of the torque member during upward movement of the valve the first and second clutch plates are moved out of frictional engagement to prevent rotational driving of the rotor by the torque member.

23. A tool according to claim 2, further comprising a rotor to which the drill bit is secured and which is rotatably mounted in the housing between the one-way clutch and the drill bit, and an axial thrust bearing which comprises at least one annular groove in the housing and at least one annular groove in the rotor, said grooves together constituting a ball bearing track, and a plurality of freely movable ball bearings disposed in the ball bearing track partially in each of said grooves whereby downward axial thrust on the housing is transmitted through the ball bearings to the rotor and the drill bit, an annular lipped pocket being provided in the rotor above and in communication with said annular groove therein for retaining the ball bearings therein during assembly and disassembly of the rotor within the housing.

24. An axial thrust bearing comprising a cylindrical tubular member having an inner face, a cylindrical member disposed within said tubular member and having an outer face adjacent the inner face of said tubular member, at least one annular groove in the inner face of said tubular member, an annular groove in the outer face of said cylindrical member in alignment wit said groove in said tubular member, said aligned grooves together constituting a ball bearing track, a plurality of freely movable ball bearings disposed in the ball bearing track partially in each of said grooves whereby axial thrust on one of said members may be transmitted through the ball bearings to the other of said members, and an annular lipped pocket provided in one of said faces of said members in communication with the annular groove therein for retaining the ball bearings therein during assembly and disassembly of said members.

25. A method of assembly of an axial thrust bearing comprising a cylindrical tubular member having an inner face, a cylindrical member disposed within said tubular member and having an outer face adjacent the inner face of said tubular member, a plurality of annular grooves in the inner face of said tubular member, a corresponding plurality of annular grooves in the outer face of said cylindrical member and each of which is in alignment with a respective one of the plurality of grooves in said tubular member, said aligned grooves together each constituting a ball bearing track, a plurality of freely movable ball bearings disposed in each ball bearing track partially in each of said grooves constituting the ball bearing track, and a plurality of annular lipped pockets each provided in one of said faces of said members in communication with a respective one of the grooves therein, the method comprising the steps of assembling the thrust bearing with at least one of said members being unhardened by:

disposing the plurality of ball bearings in each annular pocket with the lip thereon upwardly directed to retain the ball bearings therein, relatively axially moving said members to bring each annular pocket into alignment with the respective groove in the other of said members, and inverting said members and further relatively axially moving said members to align the grooves in said members, with the plurality of ball bearings being transferred from each annular pocket to be disposed partially in each groove of the respective aligned grooves, relatively rotating said members under load to seat the plurality of ball bearings in the groove of said at least one unhardened member, disassembling the thrust bearing, hardening said at least one unhardened member, and repeating said assembling of the thrust bearing.

* * * * *

UNITED STATES PATENT AND TRADEMARK OFFICE

CERTIFICATE OF CORRECTION

PATENT NO. : 4,427,079

DATED : January 24, 1984

INVENTOR(S) : BRUNO H. WALTER

It is certified that error appears in the above-identified patent and that said Letters Patent is hereby corrected as shown below:

Claims 24 and 25 should be deleted in their entirety.

On the title page after the Abstract, "25 Claims" should read -- 23 Claims --.

Signed and Sealed this

Tenth Day of April 1984

[SEAL]

*Attest:*

GERALD J. MOSSINGHOFF

*Attesting Officer*

*Commissioner of Patents and Trademarks*